US006772663B2

(12) United States Patent
Machamer

(10) Patent No.: US 6,772,663 B2
(45) Date of Patent: Aug. 10, 2004

(54) APPARATUS AND METHOD FOR ROTARY PRESSURE CUTTING

(75) Inventor: David Machamer, Wauconda, IL (US)

(73) Assignee: Tamarack Products, Inc., Wauconda, IL (US)

( * ) Notice: Subject to any disclaimer, the term of this patent is extended or adjusted under 35 U.S.C. 154(b) by 288 days.

(21) Appl. No.: 10/125,769

(22) Filed: Apr. 18, 2002

(65) Prior Publication Data

US 2002/0152860 A1 Oct. 24, 2002

Related U.S. Application Data

(60) Provisional application No. 60/285,182, filed on Apr. 20, 2001.

(51) Int. Cl.[7] ..... B65H 29/54; B26D 1/22

(52) U.S. Cl. ..... 83/37; 83/495; 83/510

(58) Field of Search ..... 83/37, 495, 505, 83/509, 510, 673, 100

(56) References Cited

U.S. PATENT DOCUMENTS

| | | | |
|---|---|---|---|
| 3,897,016 | A | 7/1975 | Shah |
| 4,244,251 | A | 1/1981 | Iwao |
| 5,363,728 | A | 11/1994 | Elsner |

*Primary Examiner*—Charles Goodman
(74) *Attorney, Agent, or Firm*—Emrich & Dithmar LLC

(57) ABSTRACT

An improved rotary pressure cutting apparatus that cuts, perforates, and scores plies of paper, window materials, label stock, and plastic laminates in conjunction with soft, discontinuous, and/or non-cylindrical anvil surfaces. A light weight, low mass anvil in the form of a metallic sheet is supported in a strike position beneath a rotating blade. The anvil is biased by springs or elastomeric members toward the strike position and moves with the material being cut and the moving cutting blade during a cut. The anvil is returned to the strike position by the biasing member upon completion of the cut.

19 Claims, 10 Drawing Sheets

APPARATUS AND METHOD FOR ROTARY PRESSURE CUTTING

RELATED APPLICATION

This application claims the benefit of the filing date of copending U.S. Provisional Application No. 60/285,182, filed Apr. 20, 2001.

FIELD OF THE INVENTION

The present invention relates to apparatus for cutting material in the form of sheets or a web such as are used, for example, in the manufacture of business forms, as well as in the paper, label and folding carton processing industries.

In the paper, label, and folding carton processing industry, webs or sheets of material must often be transversely cut (severed), perforated, or scored. In the integrated business forms industry, patches of transfer tape, release liner and adhesive, plastic laminates, RFID (radio frequency identification) tags, and window materials are often severed from a web and the resulting patches are applied to a continuous web or sheets. In the folding carton industry, windows and other features are often patched onto streams of individual, flattened cartons.

BACKGROUND OF THE INVENTION

Two methods of rotary cutting such materials are typically employed for these operations: Shear cutting between a rotating blade and a stationary blade, and pressure cutting between a rotating blade and an anvil cylinder.

In rotary shear cutting, a relatively heavy rectangular cutting blade or blades are fastened to corresponding slots in a cutting cylinder with a series of clamping bolts and adjusting screws. The cutting cylinder and blade cooperates with an approximately rectangular stationary blade. The axis of the cutting cylinder may be mounted at a slight angle to the stationary blade, or the rotary blade may be forced into a helical contour so that the material to be cut is severed progressively across its width rather than cut simultaneously. This substantially reduces cutting forces. A precisely adjusted, minuscule gap is maintained between the stationary blade and the moving rotary blade such that a thin material passing between the blades is cut, yet the blades ideally do not physically contact one another. While changing and adjusting rotary shear blades requires more skill and time, rotary shear cutting generally provides longer blade life and a cleaner cut (producing less dust) than rotary pressure cutting.

Rotary shear cutting apparatus lacks the pressure cutting apparatus' anvil cylinder and so is simpler. However, rotary shear cutting is generally not suitable for cutting materials with adhesive coatings as the adhesive tends to build up on the stationary anvil. Material may then stick to the anvil and cause a jam-up. Further, the anvil is often not easily accessed for cleaning. The rotary blade, however, could be lightly touched to an absorbent roller loaded with silicone fluid once per revolution in order to reduce the tendency of adhesive to stick to the rotary blade. Due to the minuscule gap between rotary and stationary blades, silicon fluid does not readily transfer to the stationary blade and the jamming tendency remains.

In rotary pressure cutting, relatively cheap, thin, flat blades are clamped in a slot or slots in a blade cylinder. The blades are typically clamped with a blade holding bar. The blade cylinder cooperates with an opposing, hardened anvil cylinder. The material to be cut passes between the blade and anvil cylinder. When the blade rotates into the material, the material is pinched between the blade and the anvil surface and sufficient pressure develops to sever the material.

The pressure cutting apparatus may perform alternative functions. In some cases, the height of the cutting blade is adjustable so that the material is not severed, but rather partially cut or scored, or so that one layer of a multi-layer material is selectively cut. Alternatively, a toothed blade may be used to provide perforations, a series of cuts and ties in the material, to provide a line of weakness to assist in subsequent folding or tearing. Further, the anvil cylinder may be provided with a pattern of vacuum holes. While an anvil cylinder with such holes is relatively difficult to manufacture, it allows a patch of material to be severed and conveyed on the surface of the cylinder and applied to another moving material, which may be a continuous web, sheet, carton, object, or a moving belt. Patch or label applicating machines utilize vacuum-equipped anvil cylinders for the manufacture of business forms with integrated labels and cards and other features. Patch applicating machines also use vacuum-equipped anvil cylinders to apply window patches and other features onto blanks that are made into folding cartons.

While versatile and reliable, the rotary pressure cutting method has limitations. High pressures are required to reliably sever typical materials. A rigid, hardened (roughly 62 Rockwell C or more), anvil cylinder is required to resist the repeated, direct contact of a hardened steel blade (roughly 50 Rockwell C or more). Anvil cylinders are manufactured from expensive alloy steels and hardened via careful heat treating procedures. In spite of these costly methods, the repeated, direct contact of the blade causes gradual erosion, or "scoring," of the anvil cylinder's surface. Cutting of abrasive materials, the use of excessively hard blades, or adjusting blades for excessively hard contact will accelerate damage to the surface of the anvil cylinder. Eventually, the surface of the anvil cylinder will be marked or "scored" deeply enough to inhibit clean, reliable cutting. The anvil cylinder must then be replaced, requiring not only a costly replacement anvil cylinder, but also substantial time to disassemble and reassemble the cutter, with its large frames and bearings and typically heavy cylinders.

In sheeting operations, after a sheet is cut, it is often desirable to control the sheet on rollers or belts. In order to achieve rigidity, the circumference of the anvil cylinder is usually larger than the width of the material being cut. For example, an anvil cylinder for cutting a 20 in. wide paper material may be 24 in. circumference (7.64 in. D). The blade cylinder will typically have similar dimensions. As a result, it is difficult to provide upper and lower rollers or belts to grip or support the sheets much closer than about 3 in. from either side of the cutting point. This limits the shortest piece that may be cut. The relatively long distance from an anvil cylinder to take-away belts or rollers can also cause problems when cutting flimsy or curled materials. Such materials often tend to cling to the anvil cylinder and will not extend from the cutting point sufficiently to smoothly enter the take-away rollers or belts. A scraper blade may act on the anvil cylinder to assist flow of material away from the anvil cylinder, but in practice, scraper blades are typically difficult to adjust and subject to wear. Scraper blades are also susceptible to damage from jam-ups.

Vacuum-equipped anvil cylinders are expensive to manufacture and have additional limitations. One prior art 24 in. circumference, 20 in. wide vacuum cylinder has over 1700 vacuum holes drilled into its hardened surface. Each vacuum hole may be equipped with a metering plug to control the amount of airflow. These vacuum holes communicate with 24 cross-drilled holes that extend through the 20 in. width of the cylinder. The materials, processes, and tooling used in manufacture are expensive.

Vacuum-equipped anvil cylinders experience an important limitation because vacuum holes must be located at predetermined intervals. The 24 in. circumference vacuum cylinder typically has a grid-like pattern of vacuum holes on ½ in. circumferential intervals and this does not accommodate some popular business forms repeats. For example, many business forms are printed on a 22 in. circumference press at 3⅝ in., 5½ in., 7⅓ in., 11 in. and 22 in. repeats. The vacuum cylinder with ½ in. circumferential vacuum holes will successfully apply patches on 5½ in., 11 in. and 22 in. repeats. However, if one should attempt to cut and apply patches at 3⅝ in. or 7⅓ in. intervals, the blade would regularly cut across a row of vacuum holes and the patch would not be severed. Special gearing kits and blade cylinders have been developed to provide size-specific partial solutions, otherwise a special, costly vacuum cylinder is required with vacuum holes at ⅝ in. circumferential spacing.

Flexographic printing presses provide labels and forms on ⅛ in. length increments. To provide windows, adhesive patches, RFID tags and other features on ⅛ in. increments, the size of the vacuum hole must be well under ⅛ in. D. to allow the blade to cut on either side of the vacuum hole. Holes under ⅛ in. D are relatively difficult to drill down to the cross holes and the resulting, long, small diameter hole may cause too much airflow restriction.

When patch applicators are adapted to folder/gluer machines for the folding carton industry, the physical size of the vacuum anvil cylinder may be difficult to accommodate within an existing machine. Further, patch applicators may be servo driven to simplify installation and accommodate positioning inconsistencies of carton blanks on folder/gluer transport belts. The physical size and resulting mass of a vacuum anvil cylinder requires excessively large and expensive servo mechanism drive and control systems ("servo systems").

SUMMARY OF THE INVENTION

The current invention provides a compact, easily replaceable anvil surface for pressure cutting. The anvil surface may be a thin, hardened material supported at the cut region by an opposing support, such as a cylinder, partial cylinder, curved bed or even a flat bed. The addition of an intervening ply of a thin, hard material between a rotary cutting blade and an opposing support provides a compact, low mass anvil surface suitable for cutting, scoring, or perforating. The opposing support may be a hardened cylinder but need not be hard and may be discontinuous. In other words, the anvil surface may be supported by a belt or belts and the belt or belts may be equipped with vacuum holes.

The current invention may be used in conjunction with a conventional vacuum cylinder and overcomes the repeat limitations caused by the need to avoid cutting over a row of vacuum holes.

The invention also allows the elimination of the anvil cylinder with its attendant drawbacks of size, mass, and cost. Eliminating the anvil cylinder also allows closer location of receiving belts or rollers to the cutting point and this permits handling of shorter sheet or patch lengths. This also allows more reliable delivery of sheets of relatively thin, flimsy, non-rigid material into receiving belts or rollers.

Another goal of the invention is to make it easier to add a patch applicator to existing machinery such as printing presses, envelope making machines, and folder/gluer machines for folding cartons. This is accomplished by substituting a vacuum belt assembly in place of a conventional vacuum cylinder. Vacuum belts can more easily extend into an existing machine and transfer patches onto an existing web or stream of sheets, envelopes, or cartons.

Yet another goal of the invention is to provide a lower inertia cutting system that may be more readily servo-driven at lower costs to allow the patching system to deliver accurately located patches onto sheets, envelopes, carton blanks or the like. This is especially advantageous for folder/gluer machines and the like that deliver blanks on relatively inaccurate intervals on transport belts.

BRIEF DESCRIPTION OF THE DRAWINGS

The figures represent schematic views of the represented apparatuses. The figures are not to scale and shown in a generalized orientation that in some cases could be inverted, mirror imaged or otherwise rotated or re-oriented. Terms such as "up" and "down," "before" or "after," "left" or "right," etc. are used in reference with these simplified schematics are not intended to limit the inventions disclosed.

DETAILED DESCRIPTION OF THE ILLUSTRATED EMBODIMENTS

Figure 1A:
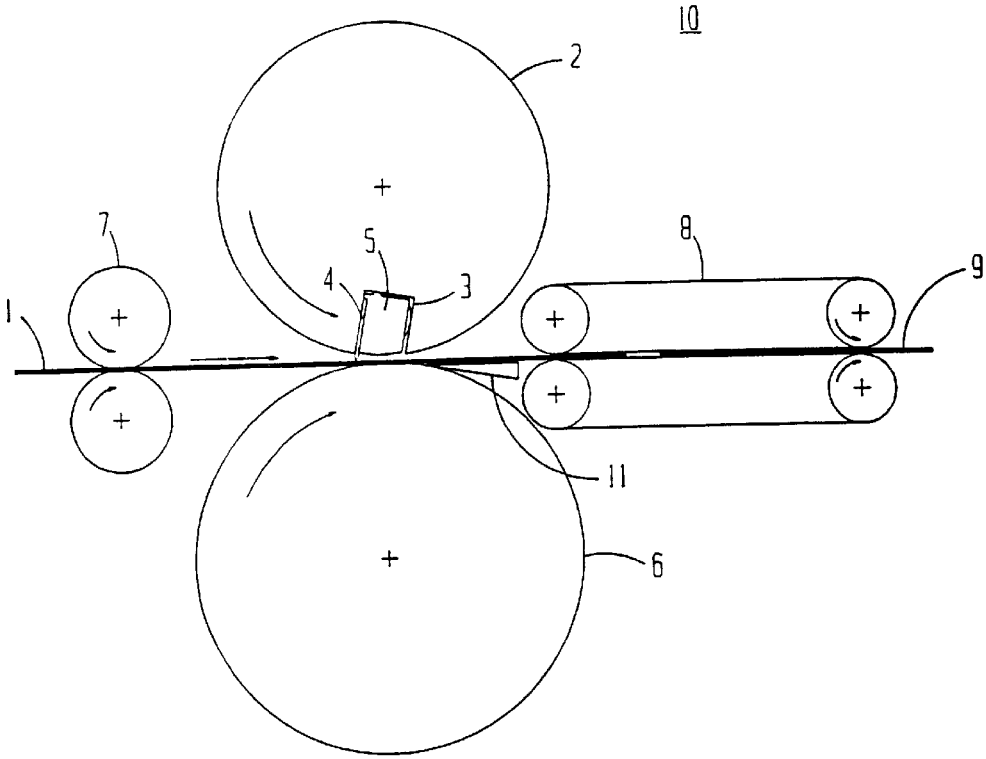
FIG. 1A. PRIOR ART
FIG. 1A is a side schematic view of a prior art pressure cutting apparatus just prior to severing a piece of material.
Figure 1B:
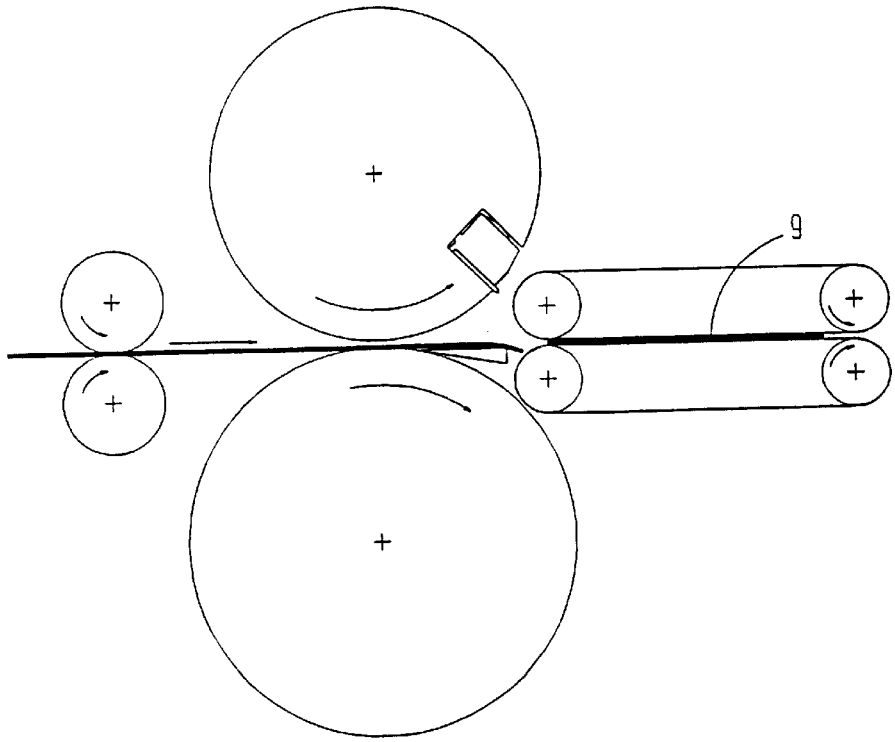
FIG. 1B. PRIOR ART
FIG. 1B is a side view of the prior art apparatus of FIG. 1A at a subsequent point in time or rotation.

FIGS. 1A and 1B are schematic illustrations of a typical sheeting mechanism 10 for cutting a continuous web of source material 1. Source material 1 may be a variety of different materials, such as paper, plastic film, glassine, laminations of adhesive and plastic films, or release liner with or without adhesive. Source material 1 may vary considerably in thickness from about 0.0005 in. to 0.020 in. or more. FIG. 1A shows the mechanism just before a cut is made and FIG. 1B shows the mechanism at a later point in rotation. A blade cylinder 2 is equipped with a slot 3 for mounting and locating a blade 4. The blade 4 (such as those provided by Zimmer Mfg. of Hawthorne, New Jersey and others) is clamped in the slot 3 via a blade holding bar 5. As the tip of blade 4 rotates into contact with the source material 1, it pinches source material 1 against anvil cylinder 6 generating sufficient pressure to sever the material to form a sheet 9. Anvil cylinder 6 is typically constructed of steel with a surface hardness of 62 Rockwell C or more. Blade 4 is also typically made of steel and the tip of blade 4 is typically hardened to 50–57 Rockwell C.

Source material 1 may be fed into the blade cylinder 2 and anvil cylinder 6 combination via feeding rollers 7. Sometimes a vacuum belt assembly is used in place of feeding rollers 7. The rotational speed of the tip of blade 4 and the surface of anvil cylinder are typically matched by timing gears or the like. The rotational speed of the tip of blade 4 and anvil cylinder 6 often matches, but may exceed, the infeed speed of the source material 1. Outfeed belts 8 grasp the protruding end of source material 1 to control it. Outfeed belts 8 also take away sheet 9 once it has been severed from source material 1. The speed of outfeed belts 8 may match or exceed the speed of the source material 1. If the outfeed belt speed exceeds the material delivery speed, the outfeed belts 8 are typically set to allow the outfeed belts 8 to slip relative to the source material 1 until it is severed. Outfeed belts 8 may also be replaced by a roller mechanism, vacuum lower belt, or other means for taking away source material 1. Blade 4 may be a severing blade, a toothed blade for perforating, or other formats for scoring as known in the art.

Some source materials 1 may tend to stick to or follow anvil cylinder 6, particularly when source material 1 is thin or relatively flimsy. A scraper 11 may be provided to encourage thin or flimsy materials to feed off of the anvil cylinder 6 and into outfeed belts 8. Note that the distance between the outfeed belts 8 and the cutting point where the tip of blade 4 engages anvil cylinder 6 depends on the size of these components. This distance can add to the difficulty of feeding the leading edge of source material 1 into the outfeed belts 8. Even with scraper 11, some forms of source material 1 may be curled or not rigid enough to enter the outfeed rollers 8 smoothly causing undesirable wrinkles or jam-ups of source material 1.

Figure 2:
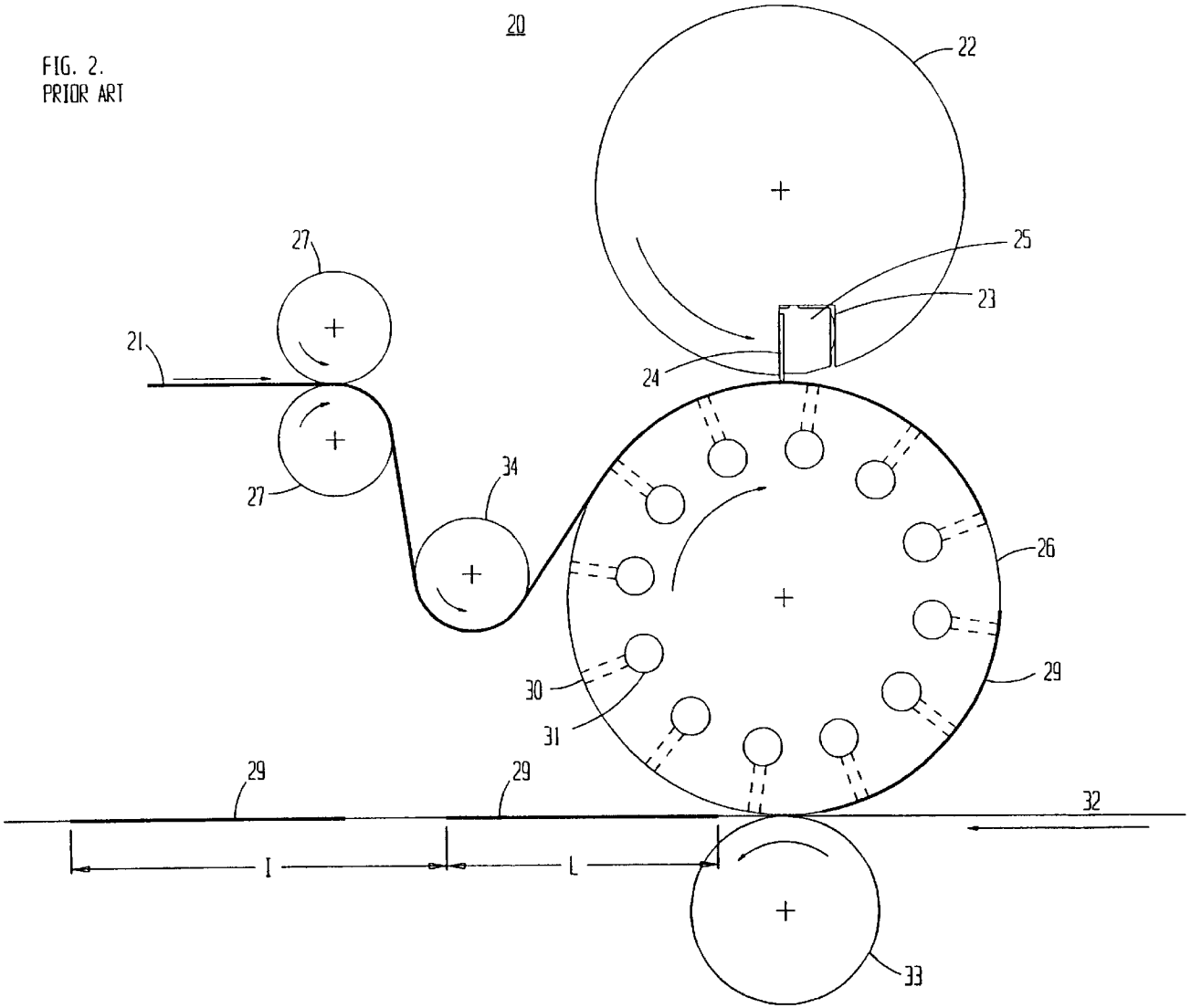
FIG. 2. PRIOR ART
FIG. 2 is a schematic side view of a prior art patching apparatus.

FIG. 2 shows a prior art vacuum-equipped patch applicator system 20 for cutting off materials 21 and applying resulting patches 29. The basics of this system are described in U.S. Pat. No. 2,990,081 of DeNeui et al. Similar to the sheeting assembly 10, vacuum-equipped patch applicator system 20 has a corresponding material 21, cutoff cylinder 22 with a slot 23, blade 24, and blade holding bar 25. The blade cooperates with anvil cylinder 26 to pressure cut or sever material 21 into patches 29. Material 21 is fed under control of feed rollers 27. Feed rollers 27 are often servo-driven to control the length L of patch 29. In most cases, the surface speed of the tip of blade 24, anvil cylinder 26 and carrier web 32 are matched, particularly during cutting, to minimize disturbance to the material 21 and prolong life of blade 24. When material 21 is fed by feed rollers 27 at a lower speed than carrier 32 speed, patches 29 are set onto the carrier web 32 at a repeat interval I. The material 21 slips on the surface of the anvil cylinder 26 until such time it is severed into a patch 29, whereupon the patch no longer slips on the anvil cylinder 26.

Patches 29 spaced on intervals I are commonly the case with business forms that may be printed on 11 in. repeats, as one example, and an integral label patch 29 is desired on each form as described in U.S. Pat. Nos. 4,379,573 of Lomeli et al or 5,098,759 of Felix or an integral card patch 29 as described in U.S. Pat. Nos. 5,466,013 of Garrison, 5,736,212 of Fischer, or 6,068,037 of Yeager et al. Many other integral label, card, windowed and other business forms products may be assembled by adding patches 29 to a web or carrier belt 32 and performing various die cutting operations. For example, patch 29 may be a transparent material to form a window, a release liner and adhesive to form an integral label, a lamination of adhesive and plastic layers to form an integral card or scratch-off layer, an RFID (radio frequency identification tag), and many other materials. Web 32 may be a continuous stream of paper business forms, plastic material, or a stream of individual sheets or cartons supported by a web or carrier belt.

Material 21 is pulled into contact with the anvil cylinder 26 via vacuum holes 30 that communicate with a vacuum source via cross-drilled holes 31. Idler roller 34 helps route the material 21 onto vacuum cylinder 26. Patches 29 are held against the surface of anvil cylinder 26 via vacuum until they are released and applied to carrier web 32. In FIG. 2, the vacuum supply to the cross-drilled holes 31 is typically controlled by a vacuum manifold (not shown) that cuts off vacuum between the six o'clock and nine o'clock positions. This allows the patches 29 to be released from the surface of the anvil cylinder 26 and be deposited on carrier web 32.

Vacuum holes 30 are typically provided in a grid-like pattern to provide a multiplicity of vacuum holding points to hold and reduce undesirable shifting of each patch 29 in contact with cylinder 26. It is important that the tip of the blade 24 does not cut across any row of vacuum holes 30; otherwise, the patch 29 will not be severed from the material 21. In the case of a vacuum cylinder manufactured by Tamarack Products Inc. of Wauconda, Ill., vacuum holes 30 are located every ½ in. around the circumference and every ½ in. across the width of anvil cylinder 26, for a total of over 1700 holes 30 and a quantity of 24 cross-drilled holes 31.

The cut-off cylinder 22 may be selected from different circumferences evenly divisible by ¼ in. to provide patches 29 on many popular form intervals I such as 4¼ in., 5½ in., 6 in., 7 in., 8½ in., 11 in. and many others. However, form interval I sizes such as 3⅔ in., 4⅔ in., 7⅓ in. are not normally possible with an anvil cylinder 26 with vacuum holes 30 arranged ½ in. around circumferentially. In some cases, special cut-off cylinders 22 and special gearing arrangements for the anvil cylinder 26 allow some ⅓ in. increments such as 3⅔ in. or a ½ in. vacuum hole arrangement, but some slippage may occur between patches 29 and carrier web 32 during application and this requires especially careful adjustment of counter-impression cylinder 33 and causes limitations as to longer patch lengths L.

Patches 29 are typically adhered to carrier web 32 by some form of adhesive (not shown) supplied on the patch 29 or on the carrier web 32. Counter-impression cylinder 33 may be used to impress the patch 29 onto carrier web 32. Alternatively, patch 29 may be adhered to carrier web 32 by static electricity. Similarly, static electricity may be used to hold patches 29 against anvil cylinder 26 as described in U.S. Pat. No. 5,776,289 of Steidinger. In this case, anvil cylinder 26 would not require vacuum holes 30 or cross-drilled holes 31 and would accommodate any desirable repeat interval I.

Figure 3A:
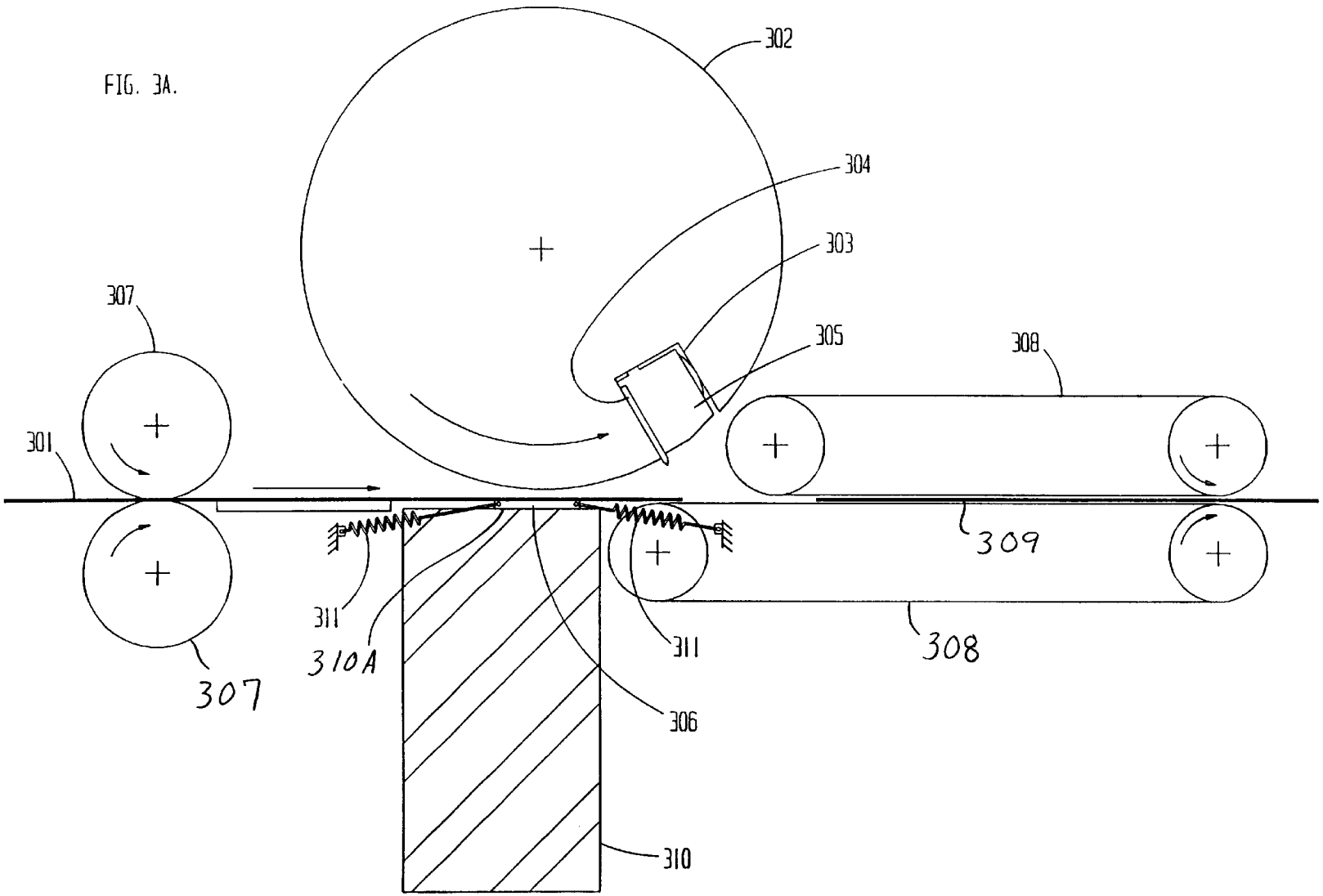
FIG. 3A is a schematic side view of one embodiment of the cutting apparatus of the present invention.

FIG. 3A shows a sheeting apparatus 300 according to one embodiment of the current invention. The mechanism 300 cuts source material 301 and includes a blade cylinder 302 equipped with a slot 303 for mounting a blade 304 fastened in the slot via a known blade holding bar 305. A thin, low mass anvil 306 is reciprocally mounted beneath the blade cylinder 302. Anvil 306 is a relatively hard (50 or more Rockwell C) metal strip that can be made from readily available materials such as "blue spring steel" such as available from McMaster-Carr Supply of Elmhurst, Ill., or could be made from a blade 304 as provided by Zimmer Mfg. of Hawthorne N.J. or Sandvik of Sweden.

Anvil 306 could be made from other hard materials such as anodized or ceramic coated aluminum or many other relatively lightweight, yet hard surfaced materials. Anvil 306 extends the full length of blade 304, and may be supported by support member 310 on surface 310A (FIG. 3B) and held in position over the support surface 310A by means of suspending springs 311 or resilient elastomeric bands or webs, one attached to either side of the anvil. Suspending springs 311 may be wire coil springs, elastomeric strip material such as neoprene-saturated elastic belting from Advanced Belting Technology of Middletown, Conn., or other elastic materials. When the blade 304 pinches source material 301 against the anvil 306, the anvil, which was in a left side position, accelerates and travels laterally (in accordance with the orientation of FIG. 3A, but its position is otherwise not limited) with blade 304 a short distance until sufficient pressure is developed to sever the source material 301 between the tip of blade 304 and anvil 306. The springs 311 allow the lateral motion of anvil 306 and then return anvil 306 to its original position as the material is severed and the blade passes the cut position.

The amount of lateral distance traveled by anvil 306 is determined by the thickness of source material 301 being cut and the curvature of the arc that the tip of blade 304 travels through. It is desirable to minimize the travel of anvil 306 to reduce strains on the spring 311 materials and extend the maximum speed of the apparatus, without encountering undesirable harmonic or dynamic resonance of the springs 311 and anvil 306. It is also desirable that the mass of anvil 306 be low to allow the anvil strip to accelerate quickly upon contact by the blade 304 and to reduce scuffing of the tip of blade 304 against the anvil surface and also to reduce the force of springs 311 required to return the anvil 306 to its initial position, after each cut. Springs 311 also may serve to urge the anvil 306 downwardly and in contact with support surface 310A.

Figure 3B:
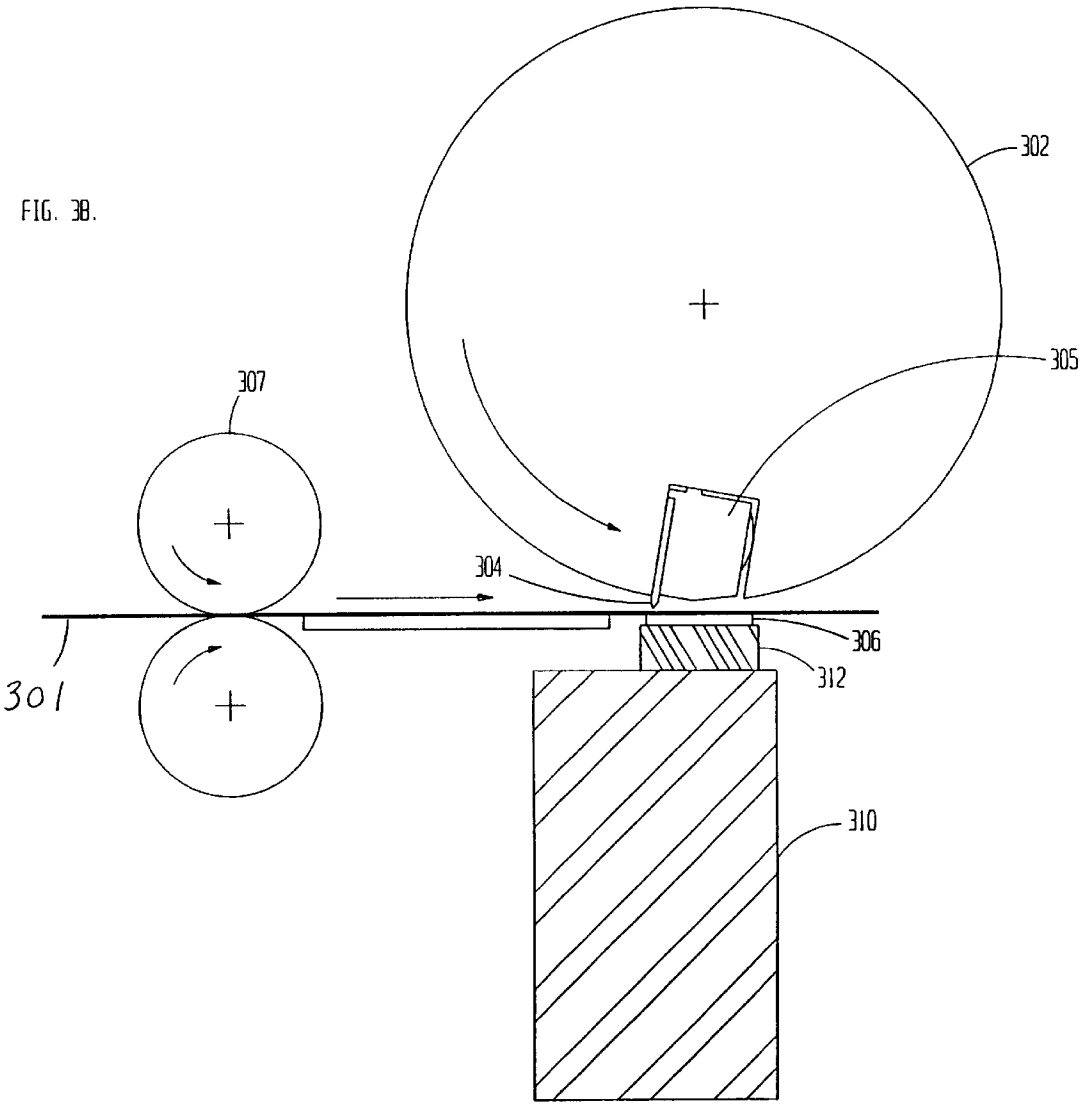
FIG. 3B is a schematic side view of an alternative cutting apparatus according to the present invention.

The reciprocating movement of anvil 306 on support surface 310A requires compatible materials, lubrication, possible interleaving of a bearing material such as oil-impregnated bronze, or rolling element bearings such as needle bearings. Another suitable interleaved material between anvil 306 and support member 310 is an elastomer material 312 as shown in FIG. 3B which may or may not be bonded to either opposing surface (i.e., of the anvil 306 or support 310). If elastomer material 312 is bonded to both anvil 306 and support member 310, the shear force generated in elastomer 312 returns anvil 306 to its original or "strike" position after a cut, thus replacing the springs 311. Deflection of elastomer 312 under cutting load may require a slightly higher setting of blade 304 via blade holding bar 305.

Infeed rollers 307 may be provided to control the infeed of source material 301. Also, outfeed rollers or belts 308 (FIG. 3A) may be used to take up sheets 309 and transport them away from the cutting apparatus. It will be observed that no anvil cylinder is used in the embodiments of FIGS. 3A and 3B. This allows at least the lower roller or belt 308 to be located much closer to the point of cutting, as seen in FIG. 3A, to better support thin or flimsy materials 301 and reduce the possibility of wrinkles or material jam-ups.

Figure 3C:
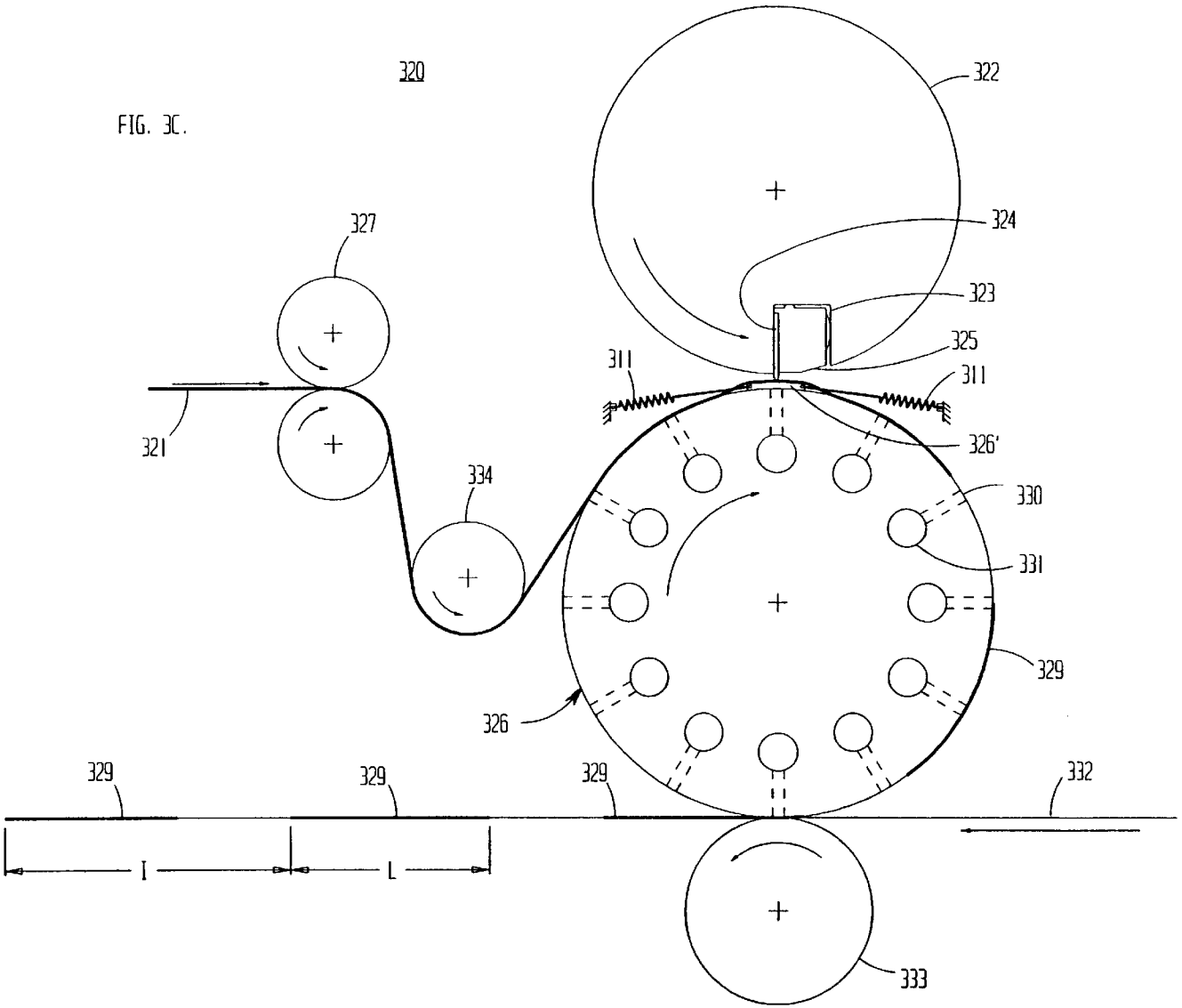
FIG. 3C is a schematic view of an embodiment of the invention in the form of a patch applicator with a vacuum cylinder.

FIG. 3C shows another embodiment of the present invention in conjunction with a vacuum cylinder patch-cutting and applicating apparatus similar to that shown in FIG. 2. One of the advantages of this embodiment is that the anvil allows cutting of blanks at any repeat such as ⅛ in., ¼ in. or ⅓ in. intervals I with a single vacuum cylinder having a fixed grid-like array of vacuum holes such as ½ in.×½ in. FIG. 3C illustrates a cutting and applicating apparatus 320 for cutting a material 321 into patches 329 and applying individual patches 329 cut from a source web 321 to a carrier web 332. Again, material 321 may be a variety of materials, and so can carrier web 332. Carrier web 332 may also be a stream or sequence of individual sheets or folding carton blanks suitably supported and conveyed.

Material 321 may be fed at a controlled rate by means of feed rollers 327 onto vacuum cylinder 326. The speed of feed rollers 327 controls the length L of patches 329. An idler roller 334 helps route material 321 from a source onto vacuum cylinder 326. Vacuum cylinder 326 is equipped with vacuum holes 330 and cross-drilled holes 331. Vacuum (i.e., suction) is supplied and controlled as disclosed in the discussion of FIG. 2. Cut-off cylinder 322 is similarly equipped with corresponding slot 323, blade 324, and blade holding bar 325. Cut-off cylinder 322 may be gear-driven so that speed of tip of blade 324 matches surface speed of vacuum cylinder 326, or it may be servo-driven to allow a profiled (i.e., momentarily matched speed during cuts), or there may even be a different speed between the cutting tip of blade 324 and the surface of vacuum cylinder 326.

The ability to tolerate different speeds between the tip of the blade 324 and vacuum cylinder 326 surface is an important practical advantage of a low-mass, moveable anvil because only the blade cylinder need be driven by the servo drive, as opposed to the typical geared arrangement between the blade and vacuum cylinder of the prior art. Thus, the inventive arrangement reduces acceleration and deceleration demands on a servo drive, allowing use of a smaller, simpler and less expensive servo drives. Anvil 326' rides atop (according to the orientation of FIG. 3C, but otherwise not so restricted) and is urged against the outer support surface of vacuum cylinder 326. Blade 324 rotates into contact with material 32 land pinches material 321 into contact with anvil 326'. When sufficient pressure develops, material 321 is penetrated by blade 324 and patch 329 is formed from the material 321. During the short time period while anvil 326' is in contact with material 321 and blade 324, anvil 326' tends to follow the vacuum cylinder 326 around in the direction of rotation. When blade 324 rotates out of contact with the material, anvil 326' is returned to its initial strike position by springs 311.

Support springs may be a variety of formats such as steel coil springs or an elastomeric band bonded or otherwise attached near each end of anvil 326'. Anvil 326' may be made from a variety of hard or hard-surfaced materials such as "blue spring steel," anodized or ceramic coated aluminum, or by modifying cutting blade 324 to suitable dimensions.

Anvil 326' may be advantageously contoured or curved to conform to the curved surface on vacuum cylinder 326. Anvil 326' preferably is relatively thin so as not to interfere with the passage of material 321 over vacuum cylinder 326 or anvil 326'. Anvil 326' is advantageously lightweight so as to allow anvil 326' to accelerate quickly to the speed of the tip of blade 324 and then return to its initial position via springs 311 of modest stiffness. On a 24 in. circumference cylinder 326, applicant has successfully used 0.010 in. thick material for anvil 326'. The surface of anvil 326' should be compatible for sliding contact on vacuum cylinder 326 by means of material specification such as electro-less nickel plating, a thin layer of UHMW (ultra-high molecular weight polyethylene) tape, and/or small amounts of lubricants such as motor oil or grease.

One important advantage of having the anvil 326' cooperate with a vacuum cylinder 326 in the strike or cutting zone is that the vacuum holes 330 are then covered by the anvil 326' in the vicinity of cutting. This allows use of a variety of cut-off cylinder 322 circumference sizes such as may be utilized to deliver patches 329 on intervals I of 4⅛ in., 7⅓ in. or 8½ in. and may be employed without having blade 324 directly contacting the cylinder over a row of vacuum holes, which would prevent proper severing of patch 329. Alternatively, a fixed size cut-off cylinder 322 may be equipped with a servo drive to drive the cut-off cylinder 322 at various different speeds to deliver a patch at intervals I such as 4⅛ in., 7⅓ in., 8½ in. or even metric intervals I corresponding to metric sheet interval I of 297 mm. Other interval I values are also possible without the problem of cutting over a row of vacuum holes 330 as with prior art machines. Suitable servo drive motors, encoders, and processors are available from Indramat of Germany and others and may be used to coordinate multiple servo drives as may be added to feed roller 327 and cut-off cylinder 322, as will be discussed.

Another important advantage of apparatus 320 is that vacuum cylinder 326 need not be hardened to resist the wear or scoring effects of blade 324. The blade 324 does not contact anvil cylinder 326 in FIG. 3C as in the prior art. Vacuum cylinder 326 of FIG. 3C need not be hardened and this greatly simplifies manufacture of vacuum cylinder 326 and reduces its cost. The benefit of not needing a hardened anvil cylinder 326 extends to apparatus that uses static electricity to hold patches 329 against cylinder 326 as well as vacuum. In some cases, there may be a benefit to hardening cylinder 326 to resist rubbing wear from anvil 326', but in such case, hardening need not be to such a high value (and thus less costly) or to as great a depth as normally required to resist the direct contact of the blade 24 pressure cutting against the surface of the supporting cylinder.

Figure 4:
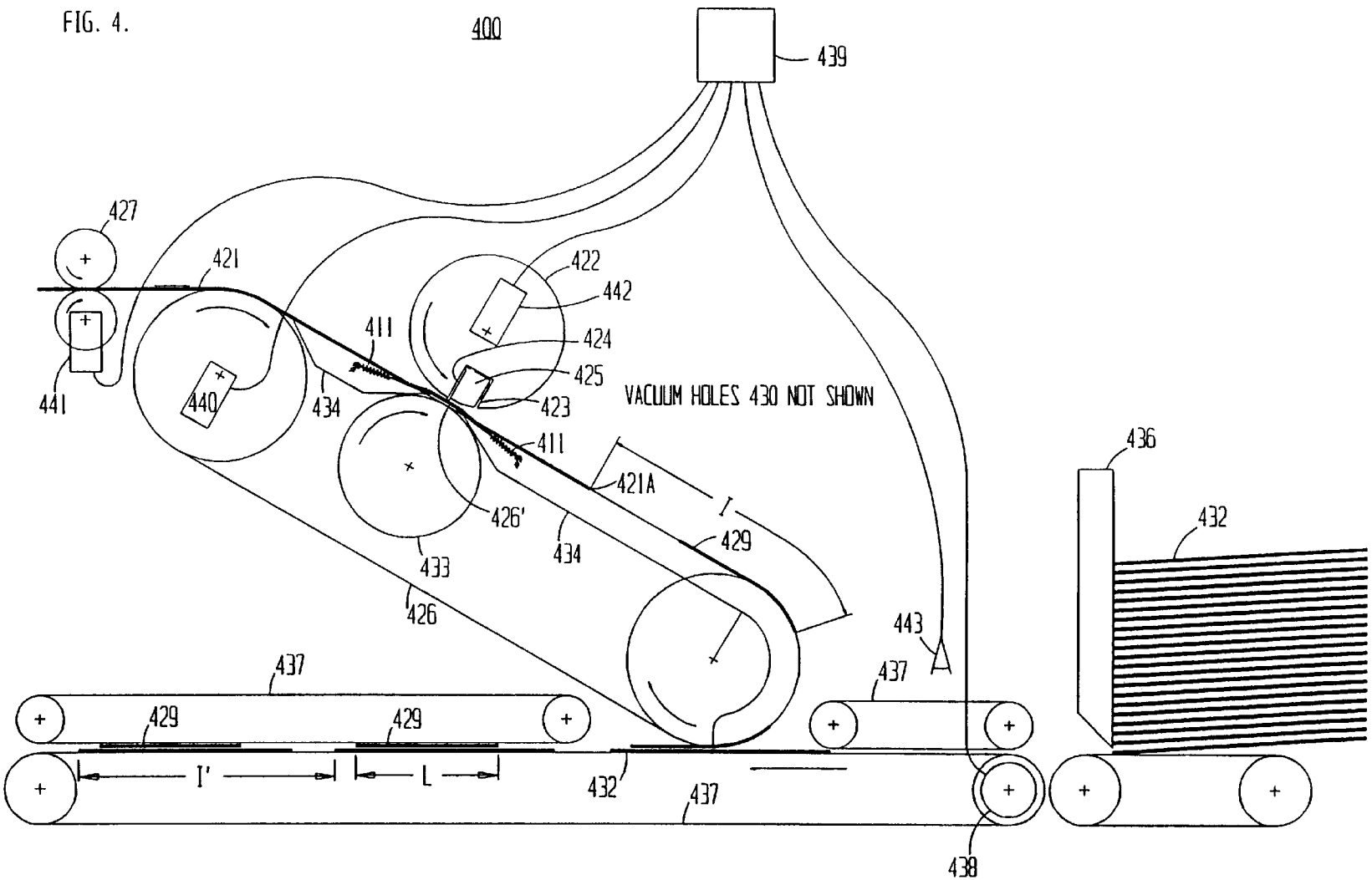
FIG. 4 is a schematic side view of an embodiment of the invention for patch applicating using a vacuum belt.
Figure 6:
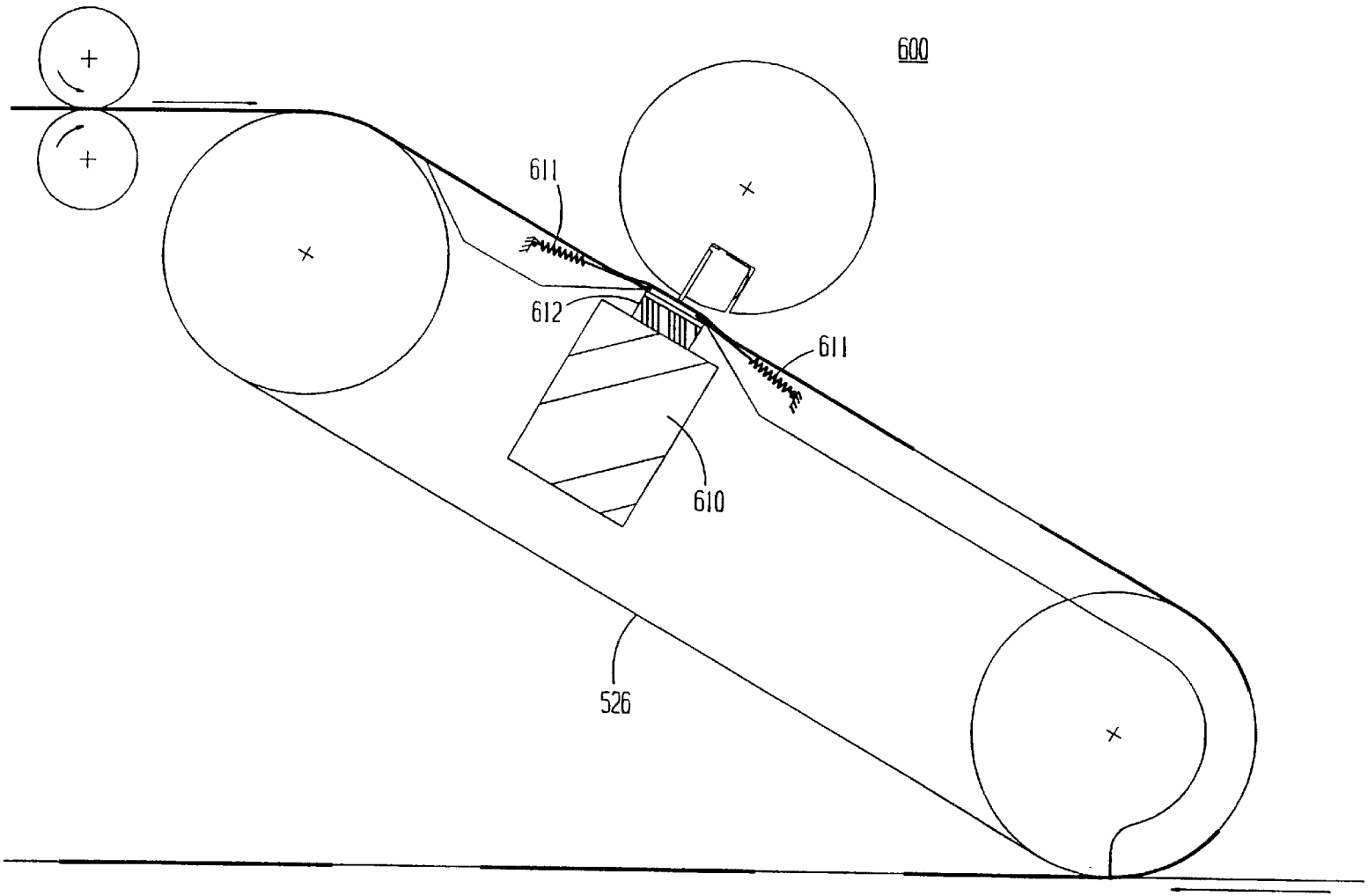
FIG. 6 is a side view of an embodiment of the invention with an alternative opposing support.

Other embodiments of the invention are shown in FIGS. 4 and 6. FIGS. 4 and 6 illustrate patch applicating mechanisms 400 and 600 that utilize a conventional vacuum belt 426 for conveying a web of material 421, cutting the web into patches 429, and applying patches 429 onto carton blanks 432. Patch source material 421 and carton blanks 432 may be different materials and formats as previously described. For example, applicator 400 may be used to apply patches onto a continuous web.

In FIG. 4, a cut-off cylinder 422 with a slot 423, a blade 424 and blade holding bar 425 cooperates with anvil member 426', vacuum belt 426 and counter-impression support roller 433 to produce the desired cut of the source material 421. Material 421 may be fed in via servo-controlled feed rollers 427 driven by servo driver 441 to provide a patch 429 of length L. Cut-off cylinder 422 may also be servo-controlled, driven by servo driver 442 to provide patches 429 on Interval I on vacuum belt 426.

Source material and formed patches are held to the vacuum belt 426 by a conventional source of suction communicating with the interior of vacuum manifolds 434 located upstream and downstream of the cutting zone. The vacuum is communicated through the belt 426 to the sheet materials being conveyed. Patches are cut and formed when blade 424 engages material 421 and pinches material 421 with sufficient pressure to sever material 421 against anvil 426'.

Anvil 426' is supported by the vacuum belt 426 and support roller 433. The support roller 433 may be an idler roller and, upon reaching operating conditions, rotates with a surface velocity approximately equal to the surface velocity of the vacuum belt 426. As the blade 424 commences a cut, pressure builds against the material 421, anvil member 426', belt 426 and the surface of idler roller 433. As the blade 424 moves through the striking zone to effect the cut, the cutting pressure is transmitted to the corresponding surface of the roller 433 directly beneath the cut. The resulting friction between the belt 426 and the surface of roller 433 imparts a tangential, drive force to rotate the roller during each cut.

Eventually, the idler roller 433 reaches the speed of the belt for practical purposes. The anvil member 426', as in the other embodiments, is biased by the resilient, restoring supports 411 to the striking position. As the blade moves through the cut zone, the anvil moves with it and the patch material (toward the right in FIG. 4). When the blade 424 completes the cut, it disengages the material 421 and the cutting pressure is released. The biasing member 411 returns the anvil 426 to its original rest position at the strike zone (unlike the continuous movement of the belt 426), poised for the next cut.

Anvil 426 may be of various formats and materials as described above, as may bias members 411. Belt material 426 may be many materials such as various suitable metals or elastomers. Applicant successfully uses elastomer belts supplied by Advanced Belting Technology of Middletown, Conn. Without anvil 426', blade 424 may likely cut into belt 426. Anvil 426' may slightly depress the vacuum belt but the stiffness of anvil 426' is such as to distribute the cutting force over sufficient area of belt to resist permanent deformation of anvil 426' and also to avoid excessively deforming belt 426 in the region adjacent the cut. If a slightly higher setting for blade 424 is required to accommodate the downward deflection of belt 426 under anvil 426', an adjustable blade bar may be employed to mount the blade 424.

Vacuum belt 426 may be driven by gears or by a servo drive 440 to deliver patches on interval I' onto a carton blank 432. Cartons blanks are often not delivered at uniform intervals I'. In this case, servo drives 441,442 on the feed rollers 427 and cutoff cylinder 422 respectively cooperate to respond to the actual position of carton blanks and deliver patches 429 on varying intervals I' Servo systems, as will be further described, including scanners to sense the position of carton blanks 432, encoders to indicate the speed and position of feed rollers 427, cut-off cylinder 422, and belt 426, as well as servo motors, gearboxes, and processors are available from Indramat of Germany.

In another embodiment of the invention, patch applicator 400 is installed on a carton folding/gluing machine such as provided by Bobst of Switzerland, Jagenburg of Germany and others. Carton blanks 432 are placed into feeder mechanism 436 which feeds carton blanks 432, one at a time, into upper and lower carrier belts 437. The speed of the carrier belts is monitored by a sensing device referred to as an encoder 438 which sends a signal to a processor-based controller 439. Controller 439 sends a signal to servo drive 440 which drives the belts 426 to match the speed of carrier belts 437 and vacuum belt 426. As blanks 432 are transported between carrier belts 437, the speed of the blanks is essentially equal to carrier belt speed. When the operator places the system into "run" mode, controller 439 sends initializing commands to servo driver 442 to rotate cut-off cylinder 422 to an initial position. Servo driver 442 is conventional, including a motor, signal encoder and gearbox, as persons skilled in the art understand.

As a carton blank 432 travels along carrier belts 437, an edge or other physical feature of the blank 432 (such as a printed mark) is sensed by scanner 436. The scanner signal provides an input to controller 439. Controller 439 then sends commands to cut-off cylinder servo driver 442 and servo drivers 440 and 441 so that cut-off cylinder 422 and feed rollers 427 rotate in cooperation so that a patch 429 of the desired length L is fed and cut-off at the proper time to provide the desired length. Patch 429 then travels along vacuum belt 426 to the desired position on carton blank 432. Controller 439 further commands servo drivers 441 and 442 to position the leading edge 421A of a following blank, and positions drive cut-off cylinder 422 to an initial or ready position. The applicator 400 is thus prepared to deliver the next patch 429 to the next carton blank 432.

Patch 429 may be fastened to carton blank 432 via adhesive, as is known. Adhesive may be applied to the film material 421 or the carton blanks 432 by printing glue patterns with a flexographic rotary gluer, with hot or cold glue nozzles or extrusion heads, pre-applied adhesive, or other means known in the art.

The operator may program or set the controller 439 via an operator interface such as a touch screen control, keypad, or personal computer to adjust patch length L and patch position on the carton blank, as is known. The Indramat servo system described above is particularly suited for controlling multiple servo-driven axes via programming of "cam" profiles. For example, the relative speeds of the cut-off cylinder 422 and feed rollers 427 may be adjusted to accommodate materials 421 with different cutting characteristics. Acetate is a relatively brittle material to cut, it often tears before it is severed completely by blade 424. In such a case, it is desirable to program the controller so that during the cutting process, the circumferential speed of the cutting blade 424 tip is nearly the same as the speed of the material 421 as controlled by the speed of feed rollers 427. In contrast, polyethylene is a relatively extensible or stretchy material and cutting may be improved by reducing the speed of the material 421 as controlled by feed rollers 427 relative to the speed of cutting blade 424 tip during the cutting process.

The servo control system thereby allows applicator 400 to deliver patches 429 on demand (that is, at a predetermined position on the carton blanks or other individual items being processed, regardless of variations of spacing between the carton blanks or other items). Further, patches 429 are not delivered if a carton blank 432 is missing, as a result, for example, of a misfeed of feeder 436 or running out of carton blanks 432. This greatly improves productivity of applicator 400 in terms of waste reduction and reduction in time spent clearing excess, often adhesive-equipped patches that may otherwise be delivered in the absence of a carton blank 432. The servo-drive controller also allows applicator 400 to accommodate the different cutting conditions for different patch materials 421.

Figure 5A:
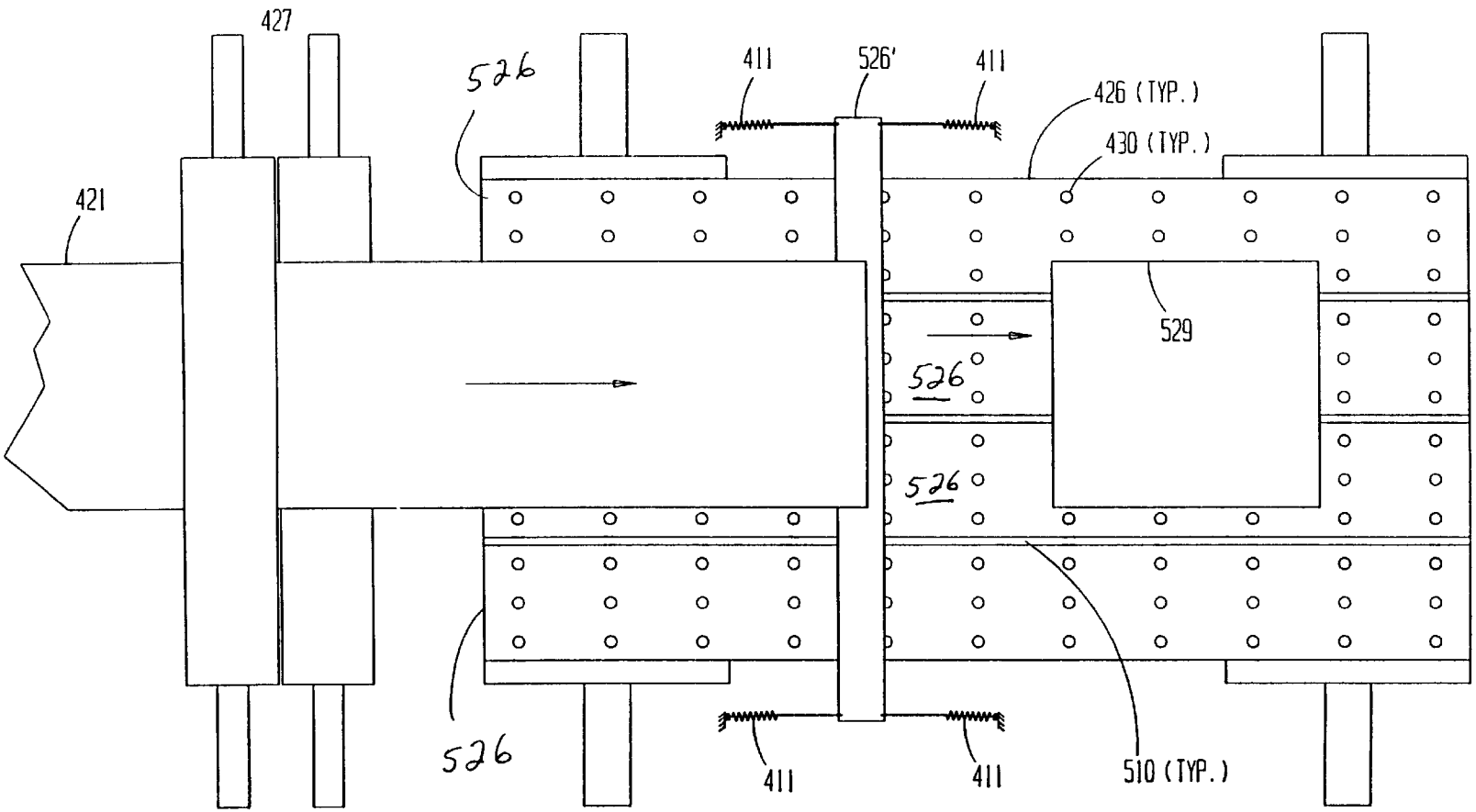
FIG. 5A is a top view of a modular arrangement of side-by-side vacuum belts.

Referring to FIG. 5A, vacuum belt 426 may be a plurality of belts arranged side-by-side to allow apparatus 400 and 600 to be constructed in various widths. Belt assemblies may be added modularly as shown in FIG. 5A to achieve a desired overall belt width. In this case, there maybe gaps 510 between belts 526 where the anvil 526' must span the regions 510 and provide sufficient rigidity for severing a wide patch 529. The instant invention readily cuts patches 529 spanning multiple gaps 510 each measuring about ¼ in. using a spring steel anvil 526' measuring 0.025 in. thick.

If elastomer belts 526 are employed, it may be difficult to provide belts having identical thickness. Also, belt thickness may vary along the width of a given belt. If a belt is approximately 0.001 in. thinner than adjacent belts, cutting of material 421 may be incomplete at locations overlying a relatively thin belt.

Figure 5B:
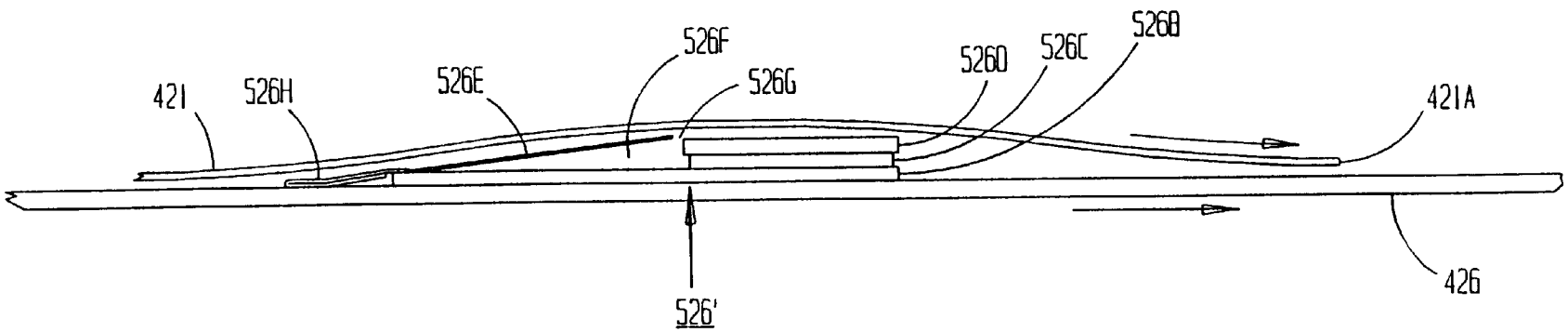
FIG. 5B is a diagrammatic side view of one embodiment of an anvil strip.

One way of overcoming variations in belt thickness is to provide a cushioned anvil strip 526' as shown in FIG. 5B. Cushioned anvil strip 526' is multi-layer construction. In one embodiment, base layer 526B may be constructed of 0.010 in. spring steel. Cushion layer 526C is a two-sided tape material such as provided by 3M (of Minnesota) 411 tape with 0.015 in. thickness. A softer cushion layer 526C may alternatively be made with 3M 4905.020 in. foam tape. Anvil layer 526D may be constructed of 0.030 in. spring steel with an electroless nickel plating to resist wear from and provide lubricity for cutting blade 424 (of FIG. 4). The cushion layer 526C provides sufficient compliance to absorb minor variations in belt thickness 526' while allowing effective and continuous contact between the top layer of anvil 526D and cutting blade 424.

The added thickness of cushioned anvil strip 526' may impede the flow of particularly thin films such as 0.001 in. thick polypropylene and acetate films. Until cut edge 421A comes back into contact with vacuum belt 426, material being processed must otherwise be pushed over anvil strip 526'; and thin, flimsy materials are not readily pushed against a stepped and/or frictional surface. To improve flow of materials over cushioned or otherwise relatively thick anvil strip 526', the base layer 526B may include an extension for mounting a ramp 526E to improve the flow of thin material 421 over the anvil strip 526'. Ramp element 526E may be constructed of various materials such as various tapes. In one embodiment, ramp element 526E may be constructed of 0.005 in. thick spring steel and attached with a thin layer of transfer adhesive or two-sided tape. In this embodiment, a cavity 526F may be provided between the ramp 526E and base member 526B. This cavity is in communication with a source of pressurized air. The pressurized air flows through gap 526G to gently "float" material 421 over the anvil strip 526'.

Each cut requires a finite duration of time and rotation of cutting cylinder 422. As the blade 424 rotates into contact with material 421, cutting forces increase as the blade 424 advances through material 421, compresses cushion layer 526C, and compresses belt material 426, particularly if belt 426 is constructed of elastomer material. Thus, the tip of the blade 424 may not rotate out of contact with the anvil strip 526' until the tip of the blade 424 passes the plane formed by the axes of cylinders 422 and 433. In this case, the leading edge of base layer 526B may tend to lift away from the surface of belt 426 and material 421 may be pushed under anvil strip 526'. If this occurs, material 421 may no longer be cut by blade 424, interrupting the process and requiring corrective action. One effective remedy for this problem is to provide a flexible flap 526H to the leading edge of base layer 526B. The flexible flap may be formed of polyester tape such as available from McMaster-Carr Supply. The vacuum from those vacuum holes 430 underlying the flexible flap 526H hold the flap in contact with belt 426 and prevent flap 526H from lifting away from belt 426. Thus it is much more difficult for material 421 to undesirably pass under or otherwise interfere with anvil strip 526'.

Flap 526H may alternatively be disconnected from anvil strip 526' so that there is less tendency for lifting of anvil strip 526' to influence the flap 526H and therefore there may be even less possibility of material 421 undesirably pushing under flap 526H and anvil strip 526'. In this case, flap 526H would be located by a separate attachment to an elastomer band spring 411 or via a separate mechanical mounting.

FIG. 6 shows another embodiment of the invention employing a vacuum belt wherein a stationary opposing support 610 (similar to the opposing surface 310 shown in FIG. 3) replaces the supporting roller 433 in FIG. 4. Should side-by-side support belts 526 have substantial differences in thickness, it may be easier to provide individual, adjustable opposing supports 610 for each belt, than to accommodate individual adjusting support rollers 433 as previously described. FIG. 6 shows both elastomeric resilient block 612 and separate springs 611 to position and return the anvil 626'. The resilient block 612 and springs 611 may be used separately or in combination.

Figure 7:
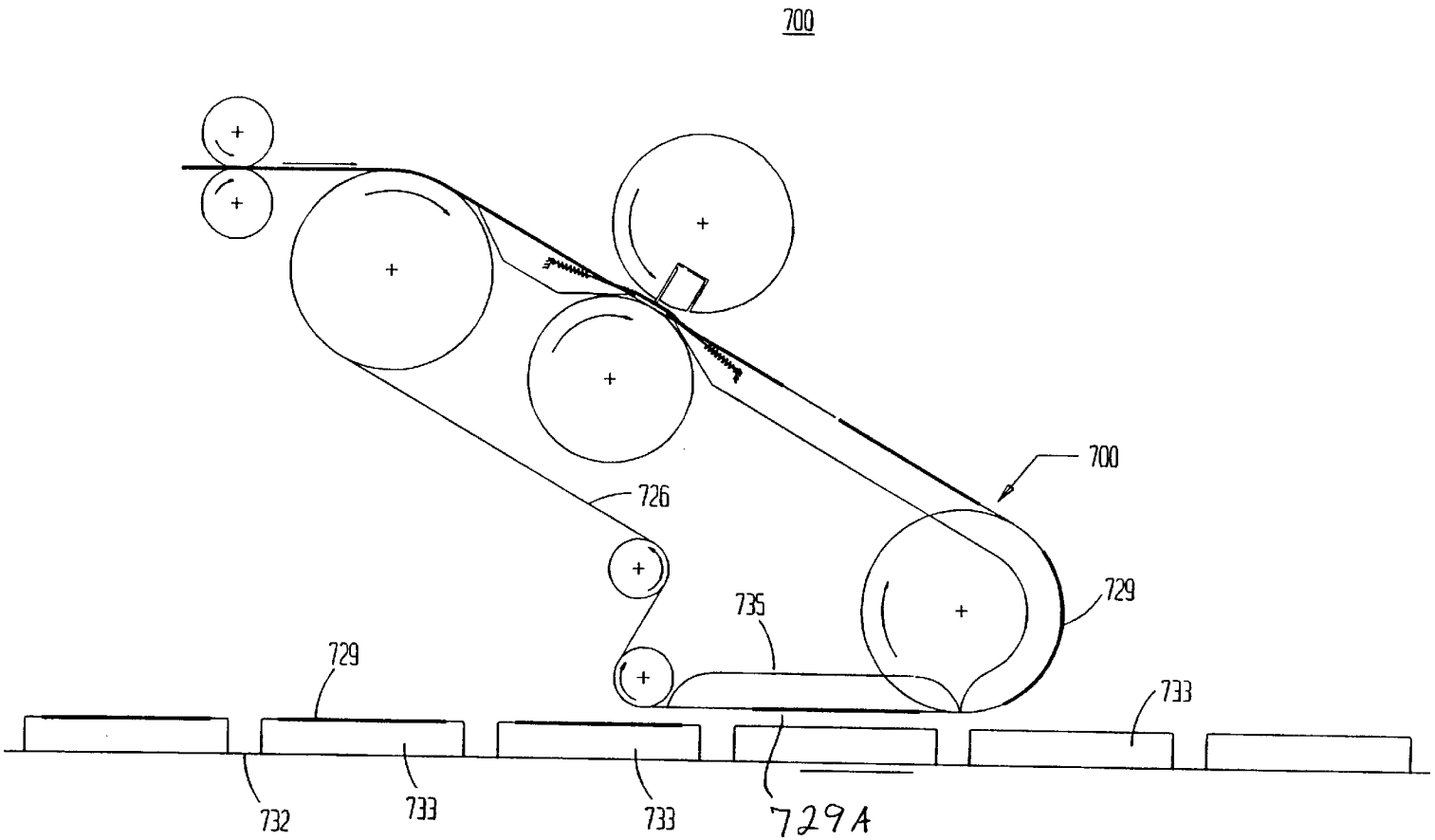
FIG. 7 is a view of an embodiment of the invention similar to the embodiment shown in FIG. 4, but with a vacuum and pressurized section to transfer patches from the belt.

FIG. 7 shows yet another embodiment of the invention in which the vacuum belt assembly 700 has been modified to provide a 'blow-down' function for applying patches 729 onto a carrier 732. As with the prior art, carrier 732 may support a stream of carton blanks or objects 733 to be labeled, individual sheets of material such as paper or a continuous stream or web of paper or other materials. The blow-down function is similar to the known "Label-aire" applicator. Pressurized air may be supplied to the additional manifold 735. The pressurized air can flow through holes to push the patches 729 in position off the belt 726 and onto the object or objects supported on carrier 732. 'Blow-down' of patches 729 may be controlled by a valve for the pressurized air source and/or by incremental rapid advancement of the belt 726 with patch 729 by a servo driver controlled by a controller such as shown at 439 in FIG. 4 and described above.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

What is claimed is:

1. Apparatus for rotary pressure cutting source material in the form of a web, comprising:

a rotating cutting cylinder having a cutting blade mounted adjacent a periphery thereof and projecting beyond said periphery;

a support defining a support surface adjacent said periphery of said cutting cylinder to define a space for receiving said source material;

a thin metal anvil of low mass;

a resilient mount securing said anvil in an initial position in said space between said cutting cylinder and said support surface;

a feeder feeding said source material into said space between said cutting cylinder and said anvil;

said cutting cylinder, support, anvil and resilient mount constructed and arranged such that when said blade is rotated to said initial cutting position and engages said source material for initial cutting action, pressure is applied to said source material and said anvil such that said anvil is moved in a direction of movement of said source material and supports said source material as said blade cuts said source material while being supported by said support, and said anvil is returned to said initial position by said resilient mount when a cut is completed.

2. The apparatus of claim 1 wherein said support comprises a rotating support cylinder having a cylindrical support surface supporting said anvil, said anvil moving in a direction of movement of said cylindrical support surface during cutting action of said source material into separate patches.

3. The apparatus of claim 1 wherein said support is stationary, said anvil moving with said blade during cutting.

4. The apparatus of claim 1 wherein said anvil is a strip of hardened metal.

5. The apparatus of claim 4 wherein said metal is sheet steel hardened to at least approximately 50 Rockwell C.

6. The apparatus of claim 3 wherein said resilient mount comprises resilient elastomeric material.

7. The apparatus of claim 3 wherein said resilient mount comprises at least first and second extension springs mounted respectively to first and second opposing sides of said anvil whereby said anvil reciprocates from said initial position to a position downstream thereof during cutting action and thence returns to said initial position for subsequent cutting action.

8. The apparatus of claim 2 wherein said support cylinder is a vacuum cylinder having a plurality of suction apertures on said cylindrical support surface for securing said source material thereto upon the application of suction, said anvil comprising a strip of hardened metal extending axially of said support cylinder and in sliding relation therewith and adapted to cover said apertures when said apertures rotate beneath said initial position of said anvil, said apparatus characterized in that said patches may be cut at all repeat intervals without having said blade engage said suction apertures.

9. The apparatus of claim 2 further comprising at least one vacuum belt having a plurality of suction apertures, said belt passing over said support cylinder and beneath said anvil, said vacuum belt providing suction to secure said source material and convey it to said cutting cylinder, said belt further conveying patches severed from said source material.

10. The apparatus of claim 9 wherein said apertured vacuum belt is made of elastomeric material, and characterized in that said blade engages said anvil during cutting action and does not engage said vacuum belt, whereby patches may be formed at any repeat without having said blade cut said source material over said apertures in said vacuum belt.

11. The apparatus of claim 9 further comprising a plurality of apertured vacuum belts in side-by-side relation passing over said support cylinder and beneath said anvil for conveying said source material and said patches.

12. The apparatus of claim 2 further comprising at least two vacuum belts adjacent one another and spaced to define an elongated suction slot for conveying said source material and said patches, said belts passing over said support cylinder and beneath said anvil.

13. The apparatus of claim 1 wherein said anvil comprises a first strip of hardened metal located to be engaged by said blade and an underlying layer of elastomeric material.

14. The apparatus of claim 2 further comprising;

a vacuum device including a vacuum belt passing over said support cylinder and beneath said anvil, said vacuum belt securing said source material and feeding the same over said anvil for cutting by said blade, said vacuum belt further conveying patches cut by said blade from said source material.

15. The apparatus of claim 14 adapted to apply said patches to blanks conveyed in a stream, said apparatus further comprising a programmable controller; an encoder measuring rotational velocity of said blade and a scanner sensing and indicating the position of said blanks and providing data to said controller, said controller controlling the feed rate of said source material and the cutting of said patches in response to said data from said encoder and said scanner to place said patches at predetermined locations on said blanks.

16. The apparatus of claim 1 adapted to cooperate with a source of discrete blanks fed along a conveyor by a second feeder at a predetermined speed, said apparatus further comprising a programmable controller; means for sensing said speed and the position of said blanks and communicating data representative of speed and position of said blanks to said controller; said controller controlling the feed rate of said source material in response to said speed and position sensing means; said first named feeder including a vacuum conveyor controlled by said controller to deliver patches cut from said source material to said blanks; said controller further controlling the speed and rotary position of said cutting cylinder such that said patches are delivered to said blanks at predetermined positions.

17. A method of pressure cutting source material having first and second sides into individual patches comprising:

rotating a cutting cylinder having a blade mounted thereto for engaging said first side of said source material;

providing a moveable anvil engaging and supporting said second side of said source material;

mounting said anvil to permit motion tangential of said cutting cylinder as said blade strikes said source material;

supporting said anvil as said source material passes said cutting cylinder in a region of cutting; and restoring said anvil to its original cutting position after each cut is completed.

18. The method of claim 17 further comprising the steps of: conveying a plurality of blanks along a path; conveying said patches after being cut to said path; sensing the feed rate and position of said blanks; controlling the speed of said source material and conveyance thereof in response to said feed rate; controlling the angular velocity and rotary position of said cutting cylinder to cut a patch in timed relation with the feeding of an associated blank; and transferring said patches onto said blanks at predetermined locations.

19. In an apparatus for pressure cutting continuous source material, the combination comprising:

a conveyor including at least one belt for supporting and conveying said source material;

a rotating cutting cylinder having at least one blade mounted thereon and positioned to cut said source material into discrete patches;

an anvil in the form of a sheet of hardened metal interposed between said source material and said belt adjacent a location where said blade contacts said source material; and a resilient mount for mounting said anvil at an initial position adjacent said location where said blade contacts said source material while permitting said anvil to move in the direction of said blade during a cut and restoring said anvil to said initial position after a cut.

* * * * *

UNITED STATES PATENT AND TRADEMARK OFFICE

CERTIFICATE OF CORRECTION

PATENT NO. : 6,772,663 B2
APPLICATION NO. : 10/125769
DATED : August 10, 2004
INVENTOR(S) : Machamer It is certified that error appears in the above-identified patent and that said Letters Patent is hereby corrected as shown below:

| COLUMN | LINE | DESCRIPTION |
|---|---|---|
| 3 | 12 | "3%" - should be -- 3-2/3 -- |
| 3 | 16 | "3%" - should be -- 3-2/3 -- |
| 3 | 21 | "%" - should be -- 2/3 -- |
| 14 | 45 | "slot" should be -- source -- |

Signed and Sealed this

Twenty-second Day of August, 2006

JON W. DUDAS
*Director of the United States Patent and Trademark Office*